US008692444B2

(12) United States Patent
Patel et al.

(10) Patent No.: US 8,692,444 B2
(45) Date of Patent: Apr. 8, 2014

(54) SOLID STATE LOW BAY LIGHT WITH INTEGRATED AND SEALED THERMAL MANAGEMENT

(75) Inventors: Jitendra Patel, Rolling Hills Estate, CA (US); Anthony W. Vilgiate, Colorado Springs, CO (US)

(73) Assignee: Infinilux, LLC, Commerce, CA (US)

( * ) Notice: Subject to any disclaimer, the term of this patent is extended or adjusted under 35 U.S.C. 154(b) by 289 days.

(21) Appl. No.: 13/049,760

(22) Filed: Mar. 16, 2011

(65) Prior Publication Data

US 2011/0228529 A1 Sep. 22, 2011

Related U.S. Application Data

(60) Provisional application No. 61/314,507, filed on Mar. 16, 2010.

(51) Int. Cl.
*H01J 1/02* (2006.01)

(52) U.S. Cl.
USPC ..... 313/46; 362/294

(58) Field of Classification Search
USPC ..... 313/45, 46; 362/294; 165/104.11
See application file for complete search history.

(56) References Cited

U.S. PATENT DOCUMENTS

2005/0030753 A1* 2/2005 Tickner et al. ..... 362/351
2007/0279862 A1* 12/2007 Li ..... 361/692
2009/0073689 A1* 3/2009 Patrick ..... 362/234

* cited by examiner

*Primary Examiner* — Andrew Coughlin
(74) *Attorney, Agent, or Firm* — KC Bean, Esq.

(57) ABSTRACT

A lighting fixture utilizing LED light sources for illumination of commercial, outdoor and other large area applications incorporates efficient heat dissipation and improved convective air flow. An integrated heat transfer assembly is disclosed that is configured to enhance heat dissipation by providing an efficient thermal conductive pathway for radiation of heat to an external environment. The lighting fixture body is configured with a lens body and heat sink having a chimney tube with internally facing finned heat sink arrangement for providing enhanced convective air flow through the light fixture body. When the heat sink transfers heat from the LED light sources during operation so as to create heated air surrounding the heat sink, ambient air is drawn through the chimney and the heated air is exhausted through air gaps so as to create a conductive air current with the environment. The heat sink fins are configured to enhance the natural air draw through the chimney by tapering the surface areas of the fins.

11 Claims, 15 Drawing Sheets

SOLID STATE LOW BAY LIGHT WITH INTEGRATED AND SEALED THERMAL MANAGEMENT

RELATION TO OTHER PATENTS

This application claims benefit, under 35 U.S.C. 119(e), of U.S. Provisional Application Ser. No. 61/314,507, filed Mar. 16, 2010, entitled "Solid State Low Bay Light with Integrated and Sealed Thermal Management", which is fully incorporated herein by reference.

BACKGROUND

1. Field of Invention

The present disclosure generally relates to solid state low bay LED lighting apparatus and systems with integrated thermal management.

2. Related Art

Practical applications for Light Emitting Diode (LED) technology have evolved rapidly in the recent past. An LED is a semiconductor based light source. LEDs have been used as indicator lamps in many devices, and are increasingly used for residential, commercial, industrial and street illumination applications. LED illumination devices are used in applications as diverse as consumer electronic products such as remote controllers, televisions, DVD players, and other domestic appliances. They are also used for aviation and automotive lighting (particularly brake lamps, turn signals and indicator) as well as in traffic signals, in low bay parking garages, and in neighborhood street lighting An LED is often small in area and has limited light output range. A number of LED lighting designs have integrated optical components such lenses or reflective surfaces to shape dispersion and radiation patterns. The development of LED technology has caused their efficiency and light output to rise exponentially, with a doubling of light output occurring about every 36 months since the 1960s, in a way similar to Moore's law. The advances are generally attributed to the parallel development of other semiconductor technologies and advances in optics and material science. LEDs present many advantages over incandescent light sources including lower energy consumption, longer life, improved robustness, smaller size, faster switching, and greater durability and reliability. LEDs powerful enough for room lighting are relatively expensive and require more precise current and heat management systems than compact florescent lamp sources of comparable output.

One limitation in the use of LED lighting is excessive heat generation and adequate thermal management. Photons that do not escape the semiconductor surface as light because of the angle of incidence are converted to heat, raising the temperature of the LED and any associated circuit board powering the LED. LED lighting performance largely depends on the ambient temperature of the operating environment. An increase of ten degrees can result in a twenty five percent reduction in luminous output. LEDs have also been developed to increase luminosity by increasing current flow. At higher currents, such designs further increase the heating of the LED, creating more concern regarding light output. Overdriving an LED in high ambient temperatures may result in overheating the LED package, eventually leading to device failure. Adequate heat management is needed to maintain luminosity and long life. This is especially important in illumination applications for automotive, aviation, municipal, commercial, and residential architectural applications where devices must operate over a wide range of temperatures and require low failure rates.

Traditionally, two general strategies have been used to manage heat, active and passive. Passive thermal management essentially has meant some type of heat sink design. There has been a variety of heat sink designs, but with current LED illumination applications, the appearance of the lighting fixture is very important to users and must match the aesthetic requirements of the surroundings. Most heat sink designs simply do not have the aesthetic appeal required for mass adoption in real world lighting applications, or do not adequately remove heat sufficient to maintain luminescent integrity and LED life.

U.S. Pat. No. 4,729,076 to Masami et al strives to lower the temperature of the LED array by attaching a finned heat sink assembly to an LED lighting array. However, there is an impediment or restrictor in the thermal transfer path from the light emitting diodes to the heat sink; namely, a resin filler or adhesive is used to attach the LED array to the heat sink, which is a very poor heat conductor. The Masami '076 patent recognizes the problem of positioning the heat sink within a traffic signal light housing, where it must exchange heat with the air within the housing. As noted in the Masami '076 patent, some means of ventilation must be provided by vents, louvers, fans or the like. These type of venting arrangement are not particularly effective in hot climates, and simply trap hot air within the enclosure with little heat exchange with the environment. Since the lens, reflector, and lamp assembly is not designed to enhance air flow excess heating in the signal housing may degrade the optical performance of the unit.

U.S. Pat. No. 6,045,240 to Hochstein, entitled "LED lamp assembly with means to conduct heat away from the LEDS" and it's related U.S. Pat. No. 5,785,418, entitled "Thermally protected LED array" disclose an electrically driven LED lamp assembly that draws excess heat from the LEDs mounted on a plate through the LED leads that are thermally connected to a second thermally conductive plate. A heat sink overlies the conductive plating and an adhesive layer of thermally conductive adhesive is disposed between the conductive plating and the heat sink to secure the conductive plating and the circuit board to the heat sink. This heat sink arrangement is complex from a manufacturing perspective and increases cost. The design is also limited in that if the ambient are is close to the same temperature as the heat sink no additional cooling can occur. This is problematic in hot climates.

United States Patent Application 20100315813 entitled "Solid state light unit and heat sink, and method for thermal management of a solid state light unit" describes a lamp assembly that manages thermal energy output from solid state lighting elements. The lamp assembly achieves enhanced cooling of light elements within the assembly by providing a heat sink having a plurality of thermo bosses protruding on a first side, and a plurality of heat sink fins on a second side. A printed circuit board is secured to the first side of the heat sink, and has a plurality of through holes that correspond to the size and locations of the thermo bosses, such that when the printed circuit board is secured to the heat sink, the thermo bosses extend into the through holes. Light elements are mounted to the printed circuit board such that the through holes are located beneath the surface area of the light element, allowing the thermo bosses to contact the back side of the light elements to provide an enhanced thermal conductive path between the light elements and the heat sink.

U.S. Pat. No. 6,481,874 to Petroski, entitled "Heat dissipation system for high power LED lighting system" also discloses a heat sink concept. Petroski uses a die that receives electrical power from a power source and supplies the power to the LED. A first side of a die support (die attachment) is secured to the die. A thermally conductive material, which acts as a heat sink, is secured to a second side of the die support. Heat within the die is transferred to the heat sink via the die support. An outer body housing is secured around the thermally conductive material. The heat is transferred from the thermally conductive material to an external environment via the outer body. In the preferred embodiment, the heat from the die is primarily transferred to the heat sink and then to the outer body via conduction, rather than radiation or convection.

U.S. Pat. No. 6,910,794 issued to Rice, discloses an automotive LED lighting system where the LED is thermally coupled to a heat transfer condensing tube or heat pipe. Heat is transferred to an evaporation area of the heat pipe. Fins are affixed to the heat pipe to assist in transfer of heat away from the heat pipe. In operation, the heat pipe is filled with a fluid such as water or some other acceptable refrigerant. As the LED operates, heat is generated and transferred to the evaporation area through the shell of the heat pipe and then to the fluid. As the temperature of the fluid reaches its boiling point, additional heat is drawn from the heat pipe and some of the fluid changes to a vapor state, expanding throughout the void of the heat pipe. As the vapor expands in the void, it contacts the heat pipe at a condensation area which is located remote from the area at or near which the LED is mounted. Since the shell of the heat pipe is cooler at the condensation area than the evaporation area, heat is transferred from the vapor to the heat pipe at the condensing area. Fins are placed external the heat pipe to assist in removing heat from the heat pipe, for example, by passing air over them. Accordingly, the condensing area is maintained at a temperature below the boiling point of the fluid. Thus, as the vapor contacts condensing area, heat is transferred from the vapor to the condensing area and out through the fins. This causes the vapor to condense into droplets of fluid which are directed to the area of the heat pipe near the LED. This design and related manufacturing process is complicated. Further, any diminished integrity of the heat tube will allow fluid to discharge from the tube and the system will fail.

U.S. Pat. No. 6,499,860, issued to Begemann, entitled "Solid state display light" discloses an LED lamp that is characterized in that the heat-dissipating means comprised of a metal tubal column that connects an LED embedded substrate and lamp cap. The outer surface of the column of the LED lamp is made of a metal or a metal alloy. This enables good heat conduction from the LED embedded substrate to the metal lamp cap. The LED lamp also includes a fan incorporated in the column, which generates an air flow during operation of the lamp to generate forced air cooling. This air flow leaves the column via holes provided in the column, and re-enters the column via additional holes provided in the gear column. By suitably shaping and positioning the holes, the air flow is led past a substantial number of the LEDs present on the substrate. One problem with this design is that the air circulates in an enclosed system and thus cannot dissipate hot air from the system. Although the fan produces increased air flow, it also undesirably and materially increases design, manufacturing and complexity of the lamp. It also generates audible sound from the fan, which is undesirable many applications.

U.S. Pat. App. No. 20040201990 entitled "transparent gas with high thermal conductivity" uses a design similar to traditional incandescent bulb design were an LED light source is mounted on a support structure. A light transparent globe encloses the light source and support structure, and an electrical input lead and return lead pass into the globe providing electrical energy to the light source. A low molecular weight gas fill, such as helium or hydrogen, is enclosed in the globe to be in thermal contact with the light source. The thermal conductivity of the fill gas cools the LED source and does not interfere with light transmission.

U.S. Pat. No. 4,595,338 entitled "Non-vibrational oscillating blade piezoelectric blower" discloses fan based on oscillations generated by a piezoelectric material. The fan includes a piezoelectric bender with a supports at its inertial nodes. Weights are attached to the bender to control the location of the inertial nodes. Flexible blades are attached to the bender at various locations and with their planes in various orientations. The blower also consists of two benders oscillating 180 degrees out of phase to further minimize vibration and noise. This fanning is useful for enhancing air circulation, but increases the number of moving parts which create maintenance issues. Failure to detect a failing fan can cause the LED to overhead and shorten its life.

U.S. Pat. No. 4,763,225 to Frenkel, et al., entitled "Heat dissipating housing for an electronic component" discloses a heat dissipating housing with a tub and an outer cover seated on the tub, which is hermetically sealed for an electronic circuit component. Heat generated at the LED and a semiconductor driver chip is transferred to finned heat sink attached to the exterior of the tub. This design depends on removal of heat to the surrounding environment and the aesthetics are not particularly desirable for most applications.

U.S. Pat. No. 7,556,406 granted to Petroski, et al., entitled "Led light with active cooling" discloses an LED lamp that includes a piezoelectric fan or synthetic jet to cool components of the lamp. Although this is an improvement over previous designs there are limitation in that air circulation within most LED fixture designs is contained in an enclosure, limiting air flow and requiring venting.

U.S. Pat. No. 7,344,279 to Mueller et al., entitled "Thermal management methods and apparatus for lighting devices" discloses various methods and systems for providing active and passive thermal or cooling for LED lighting systems, including radiating and convective thermal facilities, including fans, phase change materials, conductive polymers, potting compounds, fluid conduits, vents, ducts, pumps and other thermal facilities increasing air flow. The heat transfer means can be under control of a processor and a temperature sensor such as a thermostat to provide cooling when necessary and to remain off when not necessary. The thermal facility can also be a conduction facility, such as a conducting plate or pad of metal, alloy, or other heat-conducting material, a gap pad between a board bearing light sources and another facility, a thermal conduction path between heat-producing elements such as light sources and circuit elements, or a thermal potting facility, such as a polymer for coating heat-producing elements to receive and trap heat away from the light sources. The thermal facility may be a radiation facility for allowing heat to radiate away from a lighting unit. A fluid thermal facility can permit flow of a liquid or gas to carry heat away from a lighting unit. The fluid may be water, a chlorofluorocarbon, a coolant, or the like. A thermal conduction path conducts heat from a circuit board bearing light sources to a fixture housing, so that the housing radiates heat away from the lighting unit. Mueller's design is complex, requiring significant increases in cost as a result of increased component content and manufacturing complexity.

U.S. Pat. No. 7,819,556, issued to Heffington, et al., entitled "Thermal management system for LED array" discloses synthetic jet cooling technology that utilizes turbulent pulses of air generated from an electromagnetic actuator. The device has a chamber having a liquid disposed therein, an LED array having a first surface which is in contact with said liquid, and (c) an actuator adapted to dislodge vapor bubbles from said first surface through the emission of pressure vibrations. The devise uses a two-phase cooling system based on vibration-induced bubble ejection processes in which small vapor bubbles attached to a solid surface are dislodged and propelled into the cooler bulk liquid. Although effective, the costs for such a system in many applications if prohibitive and less costly solutions are desirable.

Active cooling systems such as described in the prior art are generally less desirable because of added production cost, manufacturing complexity, noise generated by the active cooling mechanism, and maintenance requirements.

Thus it is desirable to provide an LED lighting fixture that addresses the disadvantages of known LED illumination devices, particularly those associated with thermal management, light output and ease of installation. Accordingly, it is one object of the current invention to provide a low cost thermal dissipation system for an LED illumination fixture. Thus a need exists for a low cost LED lighting system with efficient thermal dissipation and light propagation properties. The present teachings provide such a system.

SUMMARY OF THE INVENTION

In view of the foregoing background, it is therefore an object of the invention to provide a lighting fixture utilizing LED light sources for illumination of commercial, outdoor and other large area applications that incorporates efficient heat dissipation and improved air flow.

In one aspect of the invention, an integrated lighting fixture heat transfer assembly is disclosed that is configured to enhance heat dissipation by providing an efficient thermal conductive pathway for radiation of heat to an external environment. The improved pathway focuses on heat dissipation properties of such a fixture by optimizing its surface area for providing a wider pathway with an increased area for conductive thermal transfer between an LED junction and the external ambient air. The thermal conductive pathway comprising a heat sink, a conductive heat transfer thermal bezel, and a canister housing that are thermally interfaced providing a thermal pathway from the internal environment of the lighting fixture to the external environment. The heat sink, thermal bezel and the canister are positioned with respect to each other so as to form thermal pathway, such that thermal build up generated by the LED can reach the exterior environment.

In another aspect of the current invention, a lighting fixture body is configured with a heat sink having a chimney tube with internally facing finned heat sink arrangement for providing enhanced convective air flow through the light fixture body. The chimney tube is generally configured in a vertical direction to allow heated air to naturally rise as it is heated and expands into a body canister. The heat sink and fin configuration improves convective air flow patterns for efficiently moving heat away from an LED heat source and providing efficient thermal conductive pathways and convective air flow pathways that generate improved heat dissipation through the housing and into the environment, thus reducing internal heat storage. The resulting high thermal flow rates and convection cooling system is capable of efficiently dissipating the waste heat from an LED lighting module without the need for active cooling, such as a fan or refrigeration. In contrast to conventional naturally-cooled heat sink designs, relying solely on considerations of form factor, surface area, and mass to dissipate generated thermal loads, in its various aspects and particular implementations, embodiments of the present invention additionally contemplate creating and maintaining a "chimney effect" within the fixture to eliminate heat.

In yet another aspect of the invention, a heat sink is configured with tapered fins for allowing enhanced convective thermal currents. The heat sink fins are internally directed from the heat sink tube and are tapered, being wider at one end of the tube and narrower at the other. The fin shape provides for a higher thermal energy transfer where the fins are wider and lower thermal energy transfer where the fins are narrower. This heat differential cause air to flow from areas of low heat to areas of high heat, generating convective currents as a result. These convective currents enhance air flow and thus dissipation of heat from the heat sink more quickly compared to other heat sink designs.

In sum, one embodiment of the present invention is directed to a lighting apparatus, comprising a plurality of LED light sources, a tubal heat sink thermally coupled to the LED light sources and having internally directed fins, a housing canister mechanically coupled to the heat sink through a thermally conductive pathway, a lens body that provides a chimney for allowing air flow through the heat sink, and a housing canister cap that is gapped for providing air flow between the housing canister and the external environment. The housing canister is disposed with respect to the heat sink so as to form a thermal pathway between the heat sink and the housing canister, an air channel through the lighting apparatus is provided. When the heat sink transfers heat from the LED light sources during operation so as to create heated air surrounding the heat sink, ambient air is drawn through the chimney and the heated air is exhausted through the canister cap air gap so as to create a conductive air current with the environment. The heat sink fins are configured to enhance the natural air draw through the chimney by tapering the surface areas of the fins. The lighting fixture disclosed herein particularly suited for use as a hanging pendant lighting fixture, particularly suitable for the general ambient illumination of a wide area, such as for use in a municipal street light, a parking garage, or a warehouse environment.

This and other objects, features and advantages in accordance with the present invention are provided including a formed metal housing, a heat sink with fins and a chimney tube, LED printed circuit board, a power supply, an LED driver, and lens assembly.

The metal housing acts as part of the thermal management structure as well as the primary mounting platform for all the units components. The metal housing also acts as the primary mounting structure to fix the finished fixture either via direct j-box mounting or via pendant mount on rigid conduit. The housing is round in shape, but the function is not limited to a round shape and may consist of as few as three sides or as many facets as is desired.

The heat sink can either be cast, molded or machined to accommodate any number of LED light engines. The external surfaces are faceted to accommodate flat LED light engine boards. The internal chimney tube surfaces have multiple fins to increase surface area exposed to the convective air flow. The fins may be tapered to enhance thermal conduction. The heat sink has a means of being affixed to the metal housing.

The LED driver assembly is a metal box which can be machined, cast or molded to accommodate all the electrical circuitry required to drive the LED light engines and interface with a number of standard electrical component that are accepted industry wide. The controls/driver assembly can be externally mounted but is preferably internal.

The lens is a structure with a top end fixed to a canister or housing and a closed end with an aperture in the center that aligns with the heat sink chimney to accommodate air flow and convective cooling. The shape is dictated by the number and quantity of LED light sources incorporated. The lens structure is fixed to the metal canister housing with any number of industry standard fasteners equaling. A trim ring and sealing gasket are placed between the lens and metal housing and the lens and heat sink to seal the internal volume of the lens structure from intrusion by environmental contaminants such as dirt, debris, moisture, insects or other airborne particulates.

The invention works by creating an open passage internally for free air to move, allowing for convective cooling of the light engine. The invention provides a way to create a sealed section to keep environmental contaminants from intrusion into the light engine cavity. The invention allows for all existing solid state light sources and accommodation for future technologies that require thermal management. The invention is not dependent upon structural geometric formats but upon the creation of a free air pathway isolated from the internal electronics and light sources.

The metal housing may be cast, stamped or machined from a suitably thermally conductive material in the shape dictated by the final design, and with adequate precision to mate to the lens/gasket structure. The heat sink chimney may be cast, molded or machined from a suitably thermally conductive material in the shape dictated by the final design, and with adequate precision to mate to the metal housing.

The lens may be molded, formed or machined from an optically translucent material with adequate precision to mate to the metal housing. The components must then be assembled using suitable fasteners in a fashion that applies uniform distribution of pressure to seal the gaskets and lens to the metal housing and heat sink chimney structures.

The following patents and patent applications, relevant to the present disclosure, and any inventive concepts contained therein, are hereby incorporated herein by reference: U.S. Pat. No. 6,016,038, issued Jan. 18, 2000, entitled "Multicolored LED Lighting Method and Apparatus;" U.S. Pat. No. 6,211,626, issued Apr. 3, 2001, entitled "Illumination Components;" U.S. Pat. No. 6,975,079, issued Dec. 13, 2005, entitled "Systems and Methods for Controlling Illumination Sources;" U.S. Pat. No. 7,014,336, issued Mar. 21, 2006, entitled "Systems and Methods for Generating and Modulating Illumination Conditions;" U.S. Pat. No. 7,038,399, issued May 2, 2006, entitled "Methods and Apparatus for Providing Power to Lighting Devices;" U.S. Pat. No. 7,233,115, issued Jun. 19, 2007, entitled "LED-Based Lighting Network Power Control Methods and Apparatus;" U.S. Pat. No. 7,256,554, issued Aug. 14, 2007, entitled "LED Power Control Methods and Apparatus;" U.S. Patent Application Publication No. 2007-0115665, filed May 24, 2007, entitled "Methods and Apparatus for Generating and Modulating White Light Illumination Conditions;" U.S. Provisional Application Ser. No. 60/916,053, filed May 4, 2007, entitled "LED-Based Fixtures and Related Methods for Thermal Management;" and U.S. Provisional Application Ser. No. 60/916,496, filed May 7, 2007, entitled "Power Control Methods and Apparatus."

BRIEF DESCRIPTION OF THE DRAWINGS

Embodiments of the present disclosure will be more readily understood by reference to the following figures, in which like reference numbers and designations indicate like elements.

DETAILED DESCRIPTION OF THE PREFERRED EMBODIMENTS

The present invention provide for a Solid State Low Bay Light with integrated and sealed thermal management The present invention will now be described more fully hereinafter with reference to the accompanying drawings in which preferred embodiments of the invention are shown. This invention may, however, be embodied in many different forms and should not be construed as limited to the illustrated embodiments disclosed. Rather, these embodiments are provided so that this disclosure will be thorough and complete, and will fully convey the scope of the invention to those skilled in the art. Like numbers refer to like elements throughout. The access system will now be described in detail, with reference made to FIGS. 1-14.

The foregoing description illustrates exemplary implementations, and novel features, of aspects of a solid state low bay light with integrated and sealed thermal management. Alternative implementations are suggested, but it is impractical to list all alternative implementations of the present teachings. Therefore, the scope of the presented disclosure should be determined only by reference to the appended claims, and should not be limited by features illustrated in the foregoing description except insofar as such limitation is recited in an appended claim.

Figure 1:
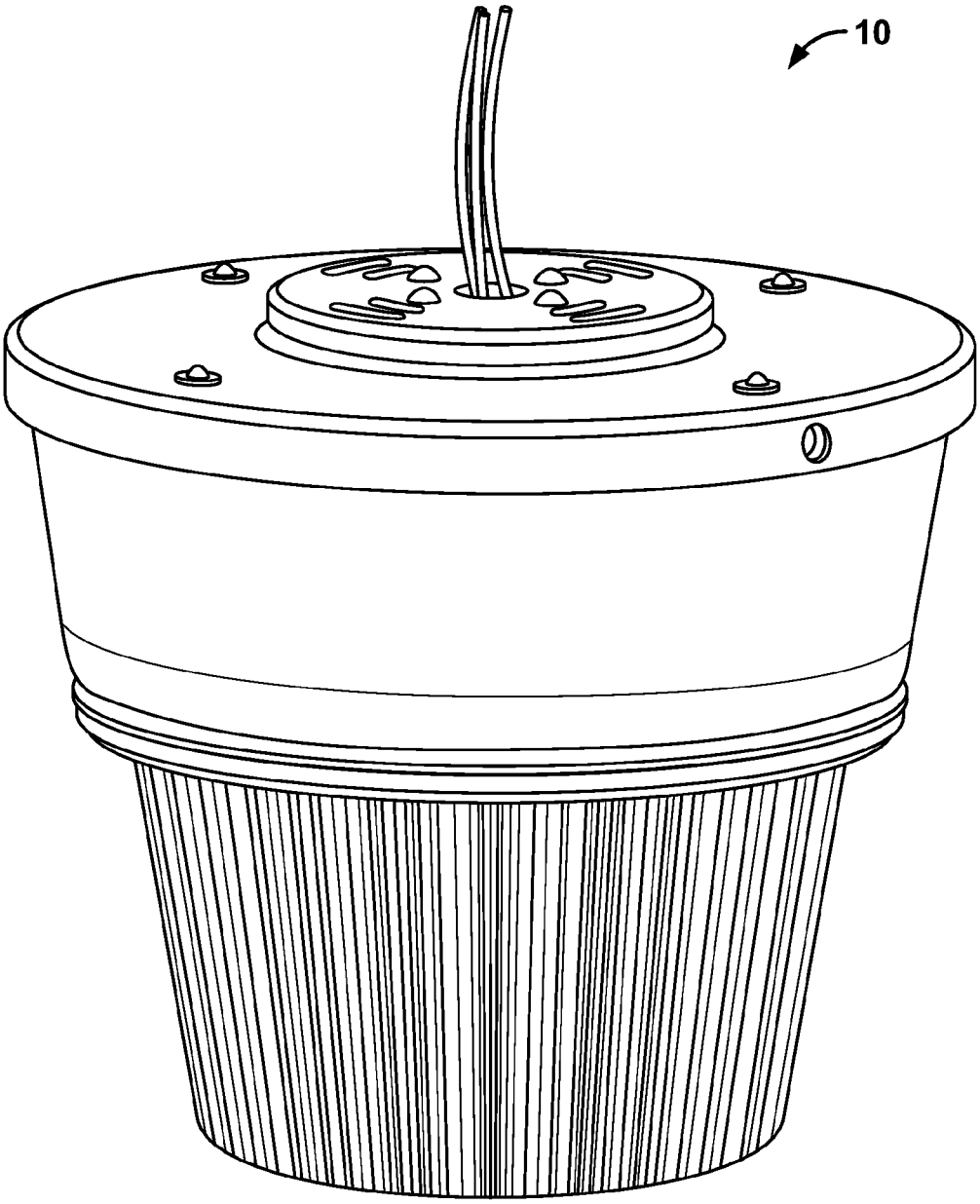
FIG. 1 illustrates one embodiment of a Solid State Low Bay Light with integrated and sealed thermal management according to the present teachings.

Referring now to the drawings where the showings are for purposes of illustrating the preferred embodiments of the invention-only and not for purposes of limiting the same. FIG. 1 provides one view of one embodiment of a lighting fixture, which is a solid state low bay light (10).

Figure 2:
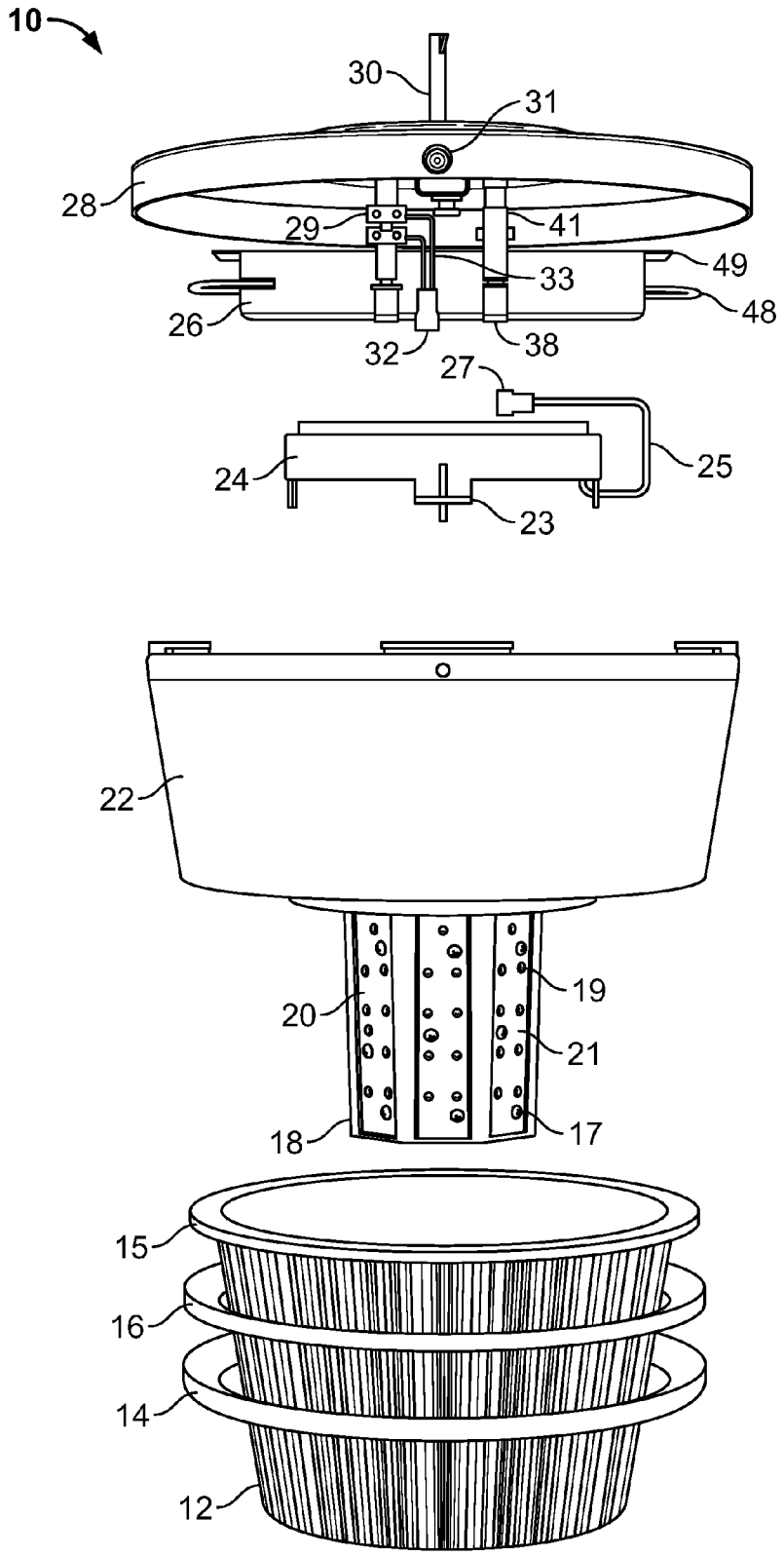
FIG. 2 is a partially exploded schematic representation of the preferred embodiment of the lighting structure according to the present invention.

FIG. 2 shows an exploded view of one embodiment of a lighting fixture (10). The lighting fixture (10) consists of a canister type housing (22), a heat sink (20) with a central tube (not shown), a heat sink bezel (18) for creating an efficient conductive thermal pathway, a plurality of LED printed circuit boards (21) with a plurality of LED lights (19) embedded thereon are mounted to the heat sink with a plurality of screws (17), a lens (12) is coupled to the canister housing (22) at the lens bezel (15) with a trim ring (14) and a seal ring (16). The lens has a chimney tube opening (not shown) that seals at the heat sink (20). An LED driver (24) is mounted internal to the canister housing (22) with mounting arms (23) and is connected to a power supply (26) by a power cable (25) with a connector (27). The canister housing (22) is covered with a top cap (28) mounted to the canister housing (22) with mounting spacers (31) at locations around the circumference of the canister housing (22). The mounting spacers provide a gap between the canister housing (22) and the top cap (28) when mounted. The top cap (28) incorporates the power supply (26) that is mounted with a mounting bracket (41) and supports (38). A power cord (30) is connected to the power supply (26) through an opening in the top cap (28) and completing a circuit with conductive electrical wires (48) through the power supply (26). The power supply (26) is connected to the LED driver (24) with a conductive electrical wire (33) and a connector (29).

Figure 3:
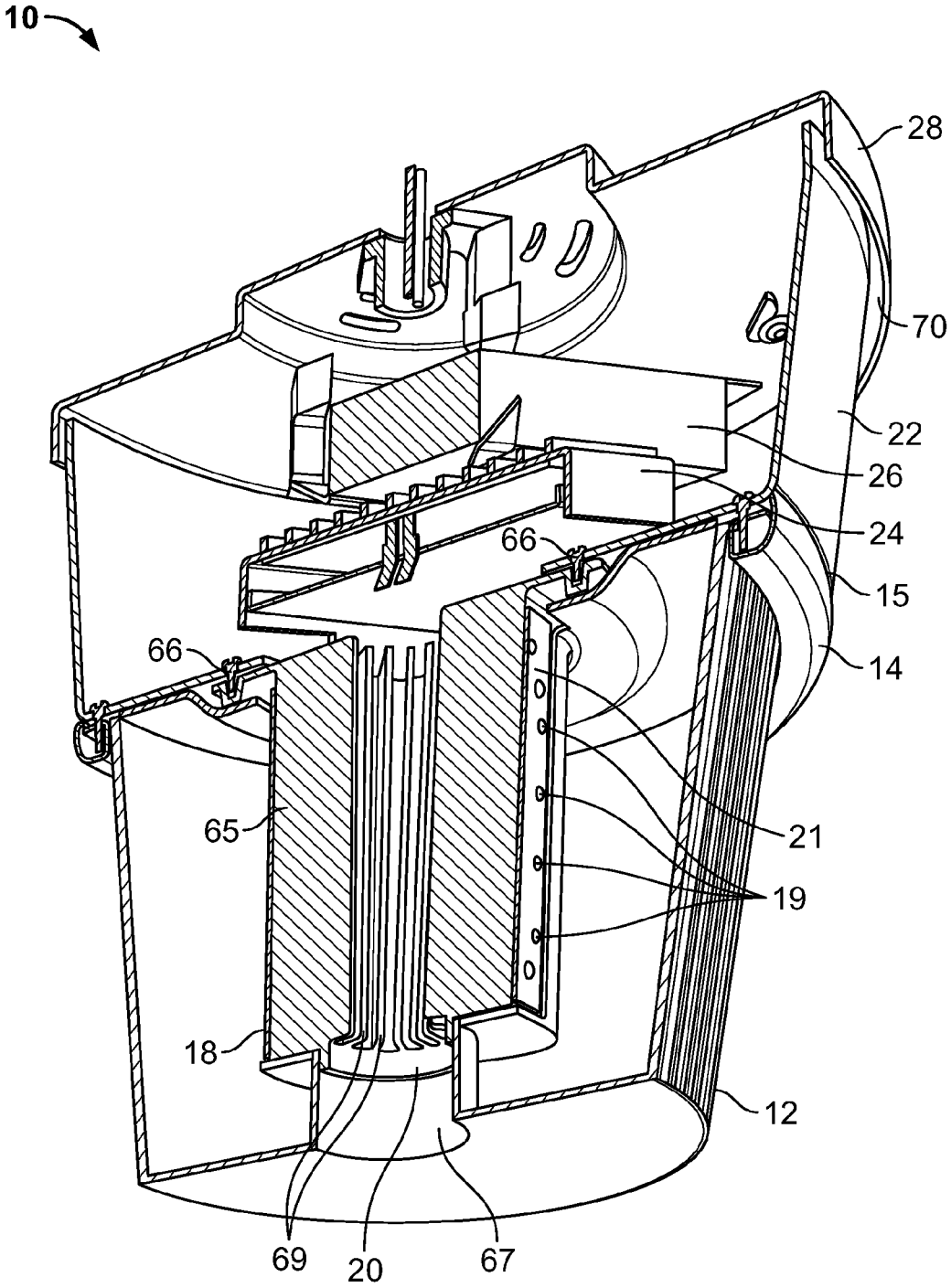
FIG. 3 is a front profile sectional view of the lighting structure of the present teachings.

FIG. 3 is a front profile sectional view of the preferred embodiment of the inventive lighting fixture (10), showing the assembled components of the lighting fixture (10). The lens (12) can be made from any translucent material that allows light to penetrate. The lens (12) is attached to a canister housing (22) is coupled to the canister housing (22) at the lens bezel (15) with a trim ring (14) and a seal ring (16) at the top of the lens (12). The lens (12) includes a chimney tube opening (67) sealed at the heat sink (20) at the bottom. The interior surface of the lens (12) may include facets (not shown) that reflect light in multiple dimensions, allowing for greater light dispersion.

The canister housing (22) is made from a thermally conductive material, preferably aluminum, and has an interior cavity enclosed with a cover (28). The interior cavity houses an LED driver (24) and provides an area for heated air to expand. The cover (28) has bracketed on its lower surface a power supply (26). The cover (28) is mounted to the canister housing (22) in a manner that provides an air gap (70) that allows air to flow from the interior cavity to the exterior environment.

The heat sink (20) is made from any material that is a good heat conductor, but for the ease of manufacturing and lower cost, is preferably aluminum. Copper can be used and is more thermally conductive than aluminum, but it is generally much more expensive and thus prohibitive. Many extrusion techniques are known for manufacturing heat sinks.

The heat sink (20) is columnar in shape and has a central tube (68) that extends through the interior length of the heat sink (20) and serves as part of a pathway for convective air flow through the lighting fixture. There are a plurality of fins (69) that project into the interior of the central tube (68) and also extends the length of the central tube (68). The fins create additions surface area that improves heat transfer. The fins are aligned vertically along the interior length of the central tube (68) in the direction for enhancing convective air flow.

A plurality of LED printed circuit boards (21) with a plurality of LED lights (19) embedded thereon are mounted to the exterior surface of the heat sink (20) with a plurality of screws (17). The heat sink assembly is place in a gap or hole on the top side of the bottom pan of the canister housing (22). Through this configuration, the heat sink (20) is in direct surface to surface contact with the canister housing providing a larger heat transfer surface areas and allowing excess heat generated in the heat sink to conductively flow to the canister housing and dissipate into the surrounding environment.

Additionally, a heat transfer bezel (18) is sleeved over the heat sink (20) and interfaced to the canister housing (22). The heat transfer bezel (18) is also made from aluminum and is in direct contact with the body of the heat sink (20) at areas between each LED printed circuit board (21) and is in direct contact with a bottom pan of the canister housing (22). The top rim surface of the heat transfer bezel (18) overlaps with the bottom surface of the pan of the canister housing (22) so that as much area as possible interfaces, allowing greater conductive heat transfer between the heat sink (20) and canister housing (22). As each LED (19) is powered, excess heat that is generated is transferred to the heat sink (22). The heat sink bezel (18) provides a conductive thermal pathway to conductively move heat from the heat sink (20) through the heat sink bezel (18) to the canister housing (22) to the exterior environment.

Figure 4A:
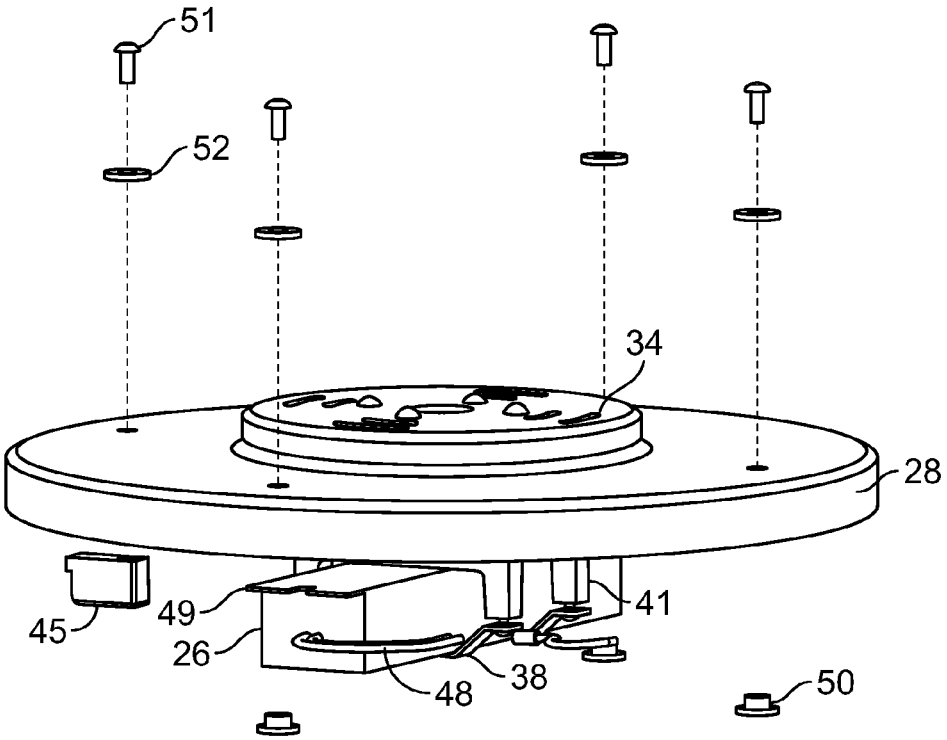
FIGS. 4A and 4B are schematic representations of top cover of the preferred embodiment of the present teachings.
Figure 4B:
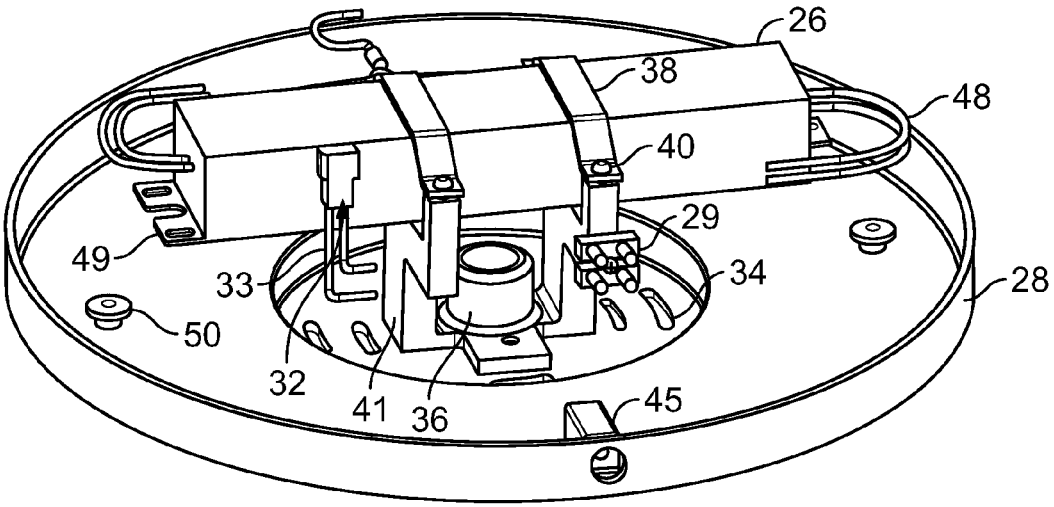

Now with reference to FIGS. 4A and 4B, the top and bottom side of the top cover (28) is shown. The top cover (28) is mounted to the canister housing with mounting brackets (45). The top cover (28) includes a plurality of grooves (34) for providing venting to allow convective currents to move through the canister housing chamber. The grooves (34) may also be used for mounting the lighting fixture in the desired environment, either to a traditional J-box or other mounting structure. A threaded conduit (36) extends through the top cap (28) for additional mounting options and for providing a channel to run a power cord from the power grid to the power supply (26). The power supply (26) supplies power to the LED driver. More specifically, the power supply (26) is provided to convert general-purpose alternating current (AC) electric power from the mains (100-227V in North America, parts of South America, Japan, and Taiwan; 220-240V in most of the rest of the world) to usable low-voltage direct current (DC) power for the internal components. The power supply may include a switch to change between 230 V and 115 V. In other embodiments, an automatic sensor that switches input voltage automatically is provided, enabling the light fixture to accept any voltage between those limits.

The power supply (26) is mounted to the top cover (28) using a mounting bracket (41), mounting braces (38) and screws (40). Additionally, fasteners (51), with spacers (52) and fastener back (50) can be used. The power supply (26) has a power output line (32) with a connector (29) for connection to the LED driver.

Figure 5:
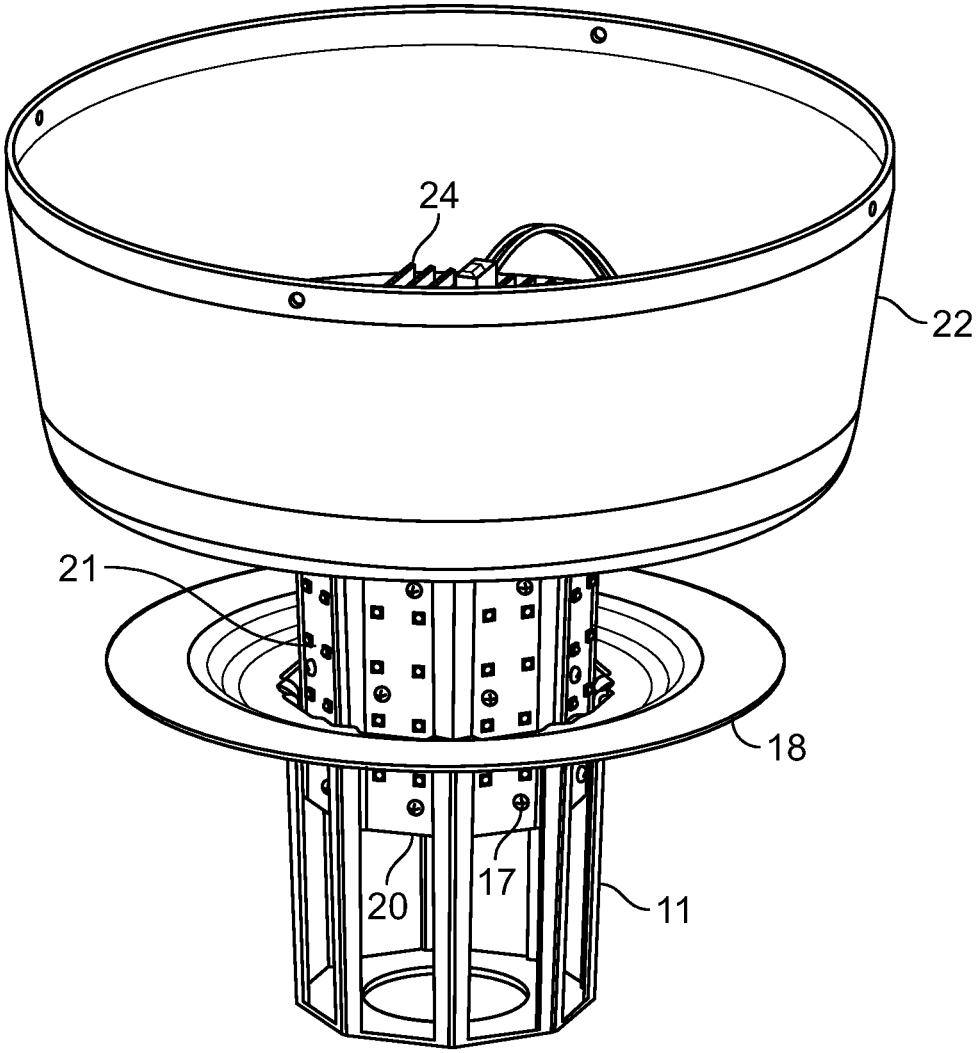
FIG. 5 is a schematic drawing to the conductive pathway of the present invention.
Figure 6:
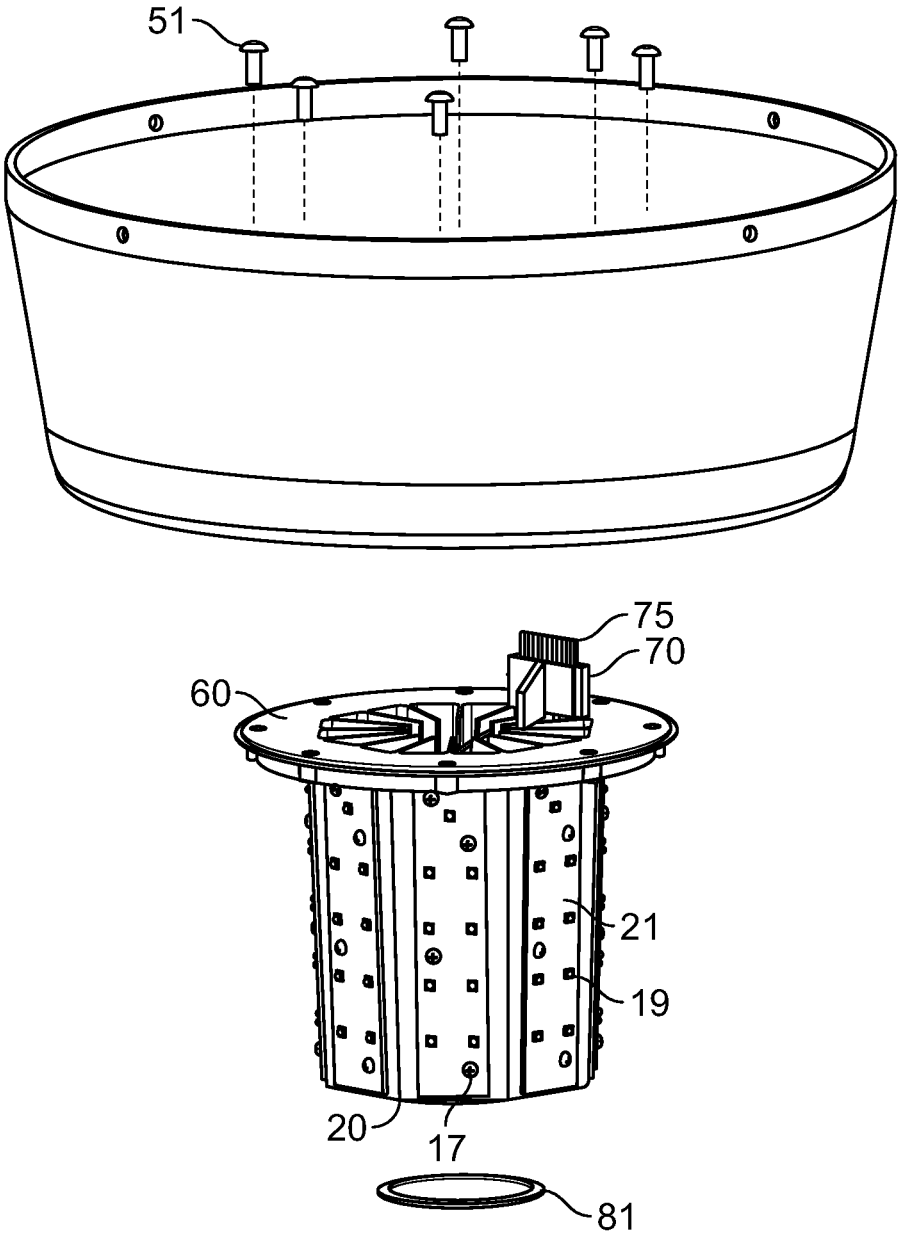
FIG. 6 is another schematic representation of the heat sink and canister of the present invention.

FIGS. 5 and 6 show the conductive heat transfer assembly of the current invention. The heat sink (20) is secured to the bottom pan of the canister housing (22) where flanges of the heat sink (60) overlap with the surface area of the bottom pan and is secured with small screws (51) and thermal glue. The heat sink bezel (18), is sleeved over the heat sink (20) where riser columns (11) directly contact the heat sink (20) at surface areas not covered by the LED printed circuit boards (21). The top flange of the bezel (18) directly contacts the bottom surface of the pan of the canister housing (22). Thermally conductive glue may be used to ensure tight contact. A connector (70) with connector pins (75) is mounted to a connector post (80) and provides connection with the LED driver mounted to interior cavity of the canister housing (22) for providing power to each LED printed circuit board (21).

Figure 7:
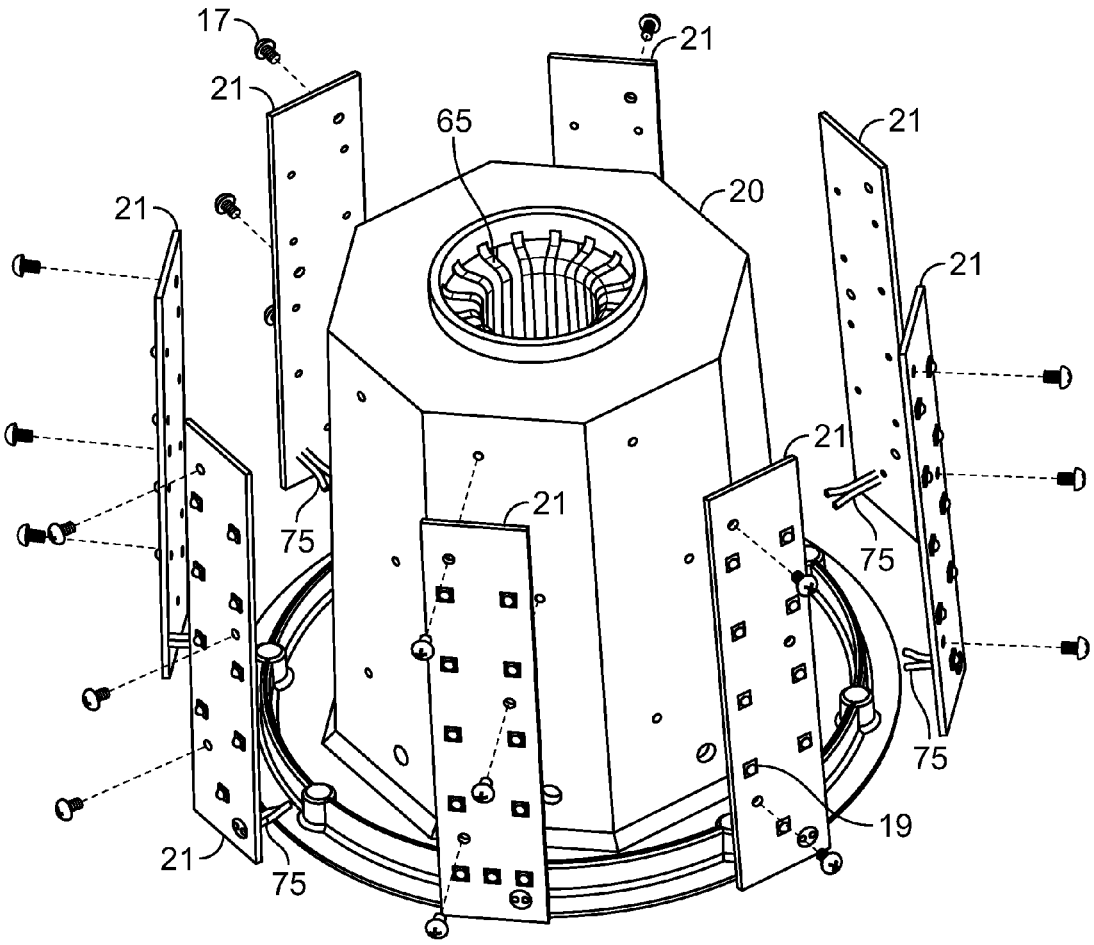
FIG. 7 is a schematic drawing of the LED engines and the method of fixing them to the heat sink.
Figure 8:
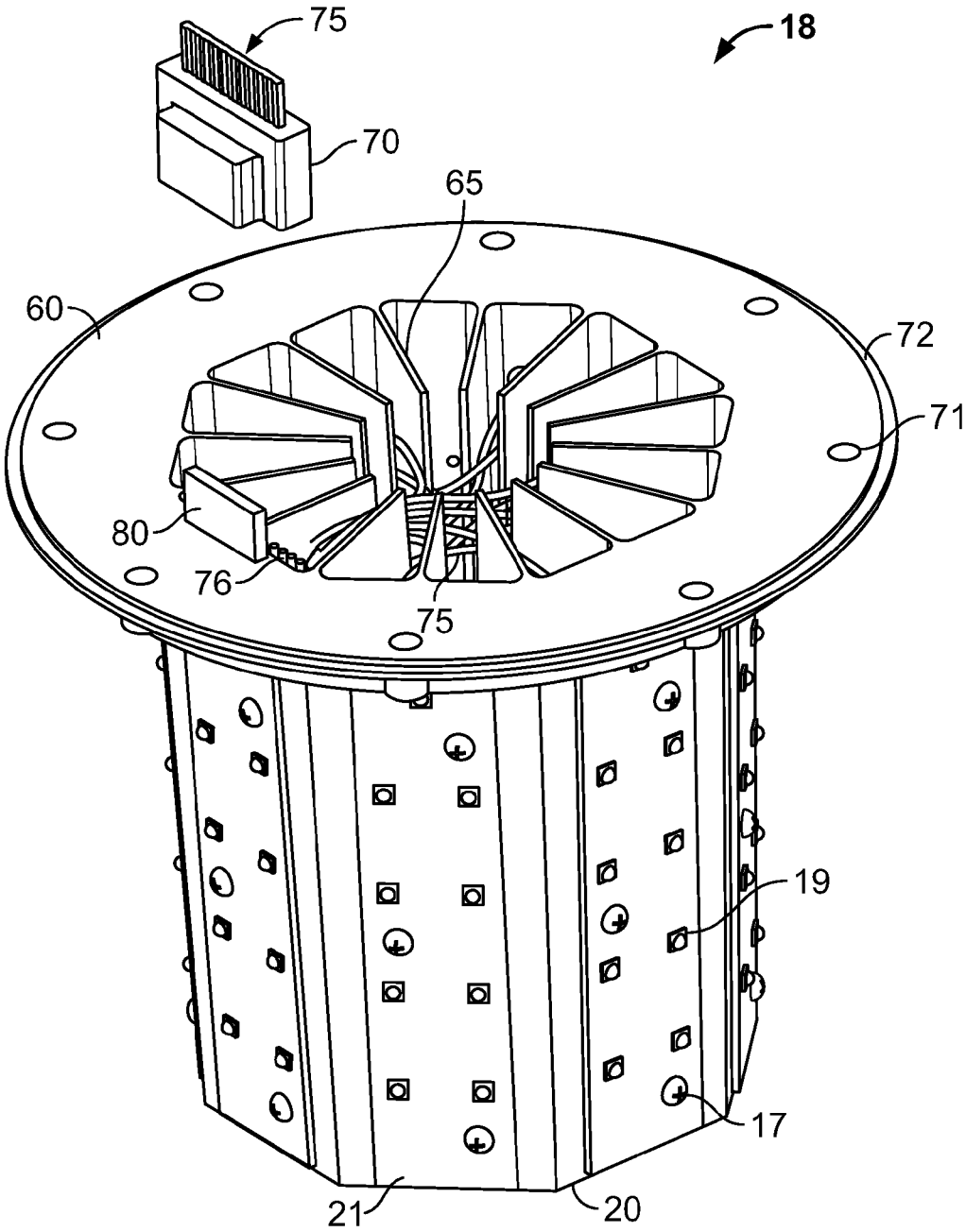
FIG. 8 is a schematic drawing of the heat sink with the LED engines fixed.
Figure 9:
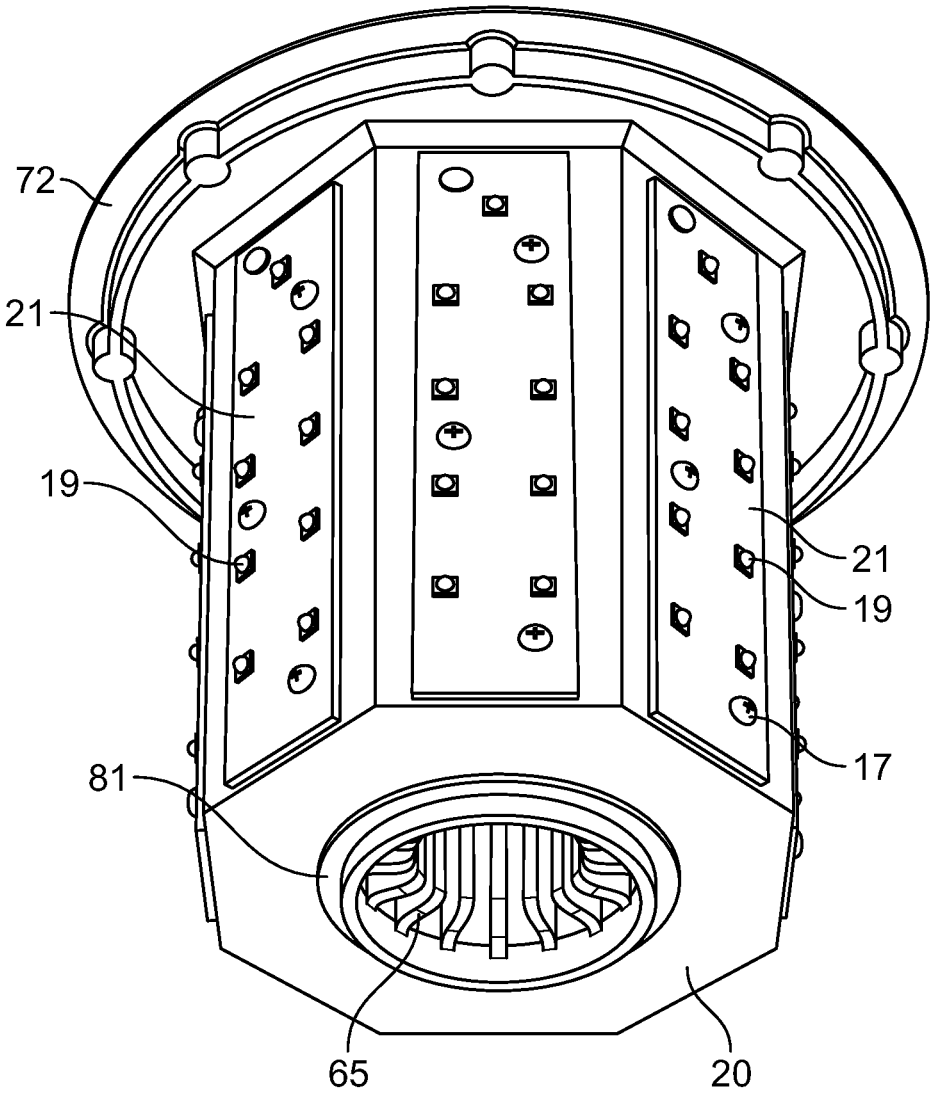
FIG. 9 is a schematic drawing of the heat sink showing the central chimney tube.

Now with respect to FIGS. 7, 8, and 9, the heat sink (20) is shown with the LED printed circuit boards (21) assembly. In the preferred embodiment, the heat sink (20) is columnar with an octagonal outer surface and a plurality of fins (65) extending inward to form an internal tube. A printed circuit board (21) with multiple LEDs is mounted with thermal glue and screws (17) to each facet of the heat sink (20). Each LED printed circuit board included a plurality of LED light sources (19) that are powered by the printed circuit board through electric leads (75) run through heat sink to the connector housing (70) on the upper portion of the heat sink (20). FIG. 9 shows the assembled heat sink assembly.

Figure 10:
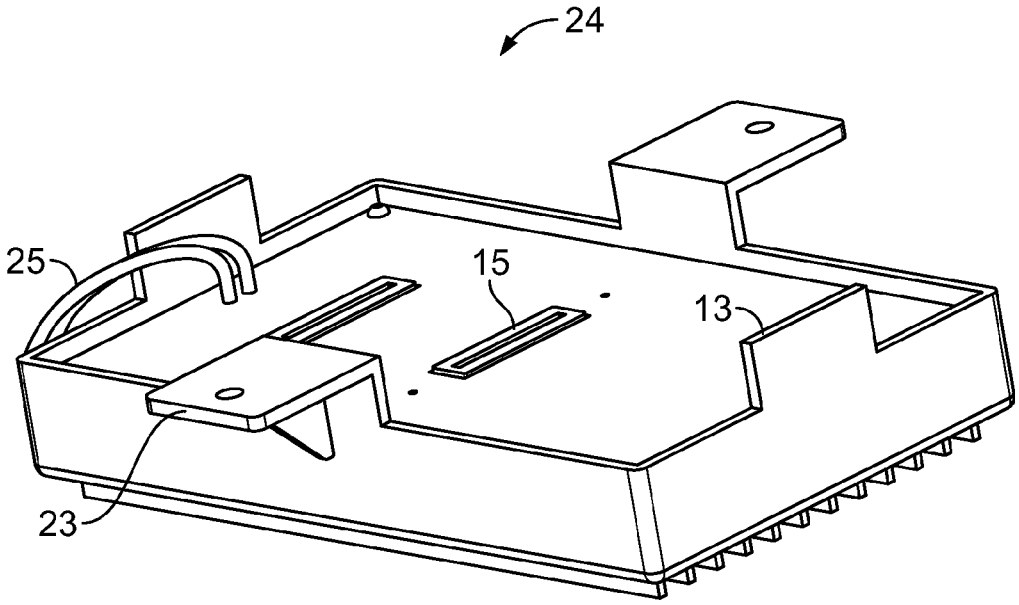
FIG. 10 is a schematic drawing of the LED driver of the current invention.
Figure 11:
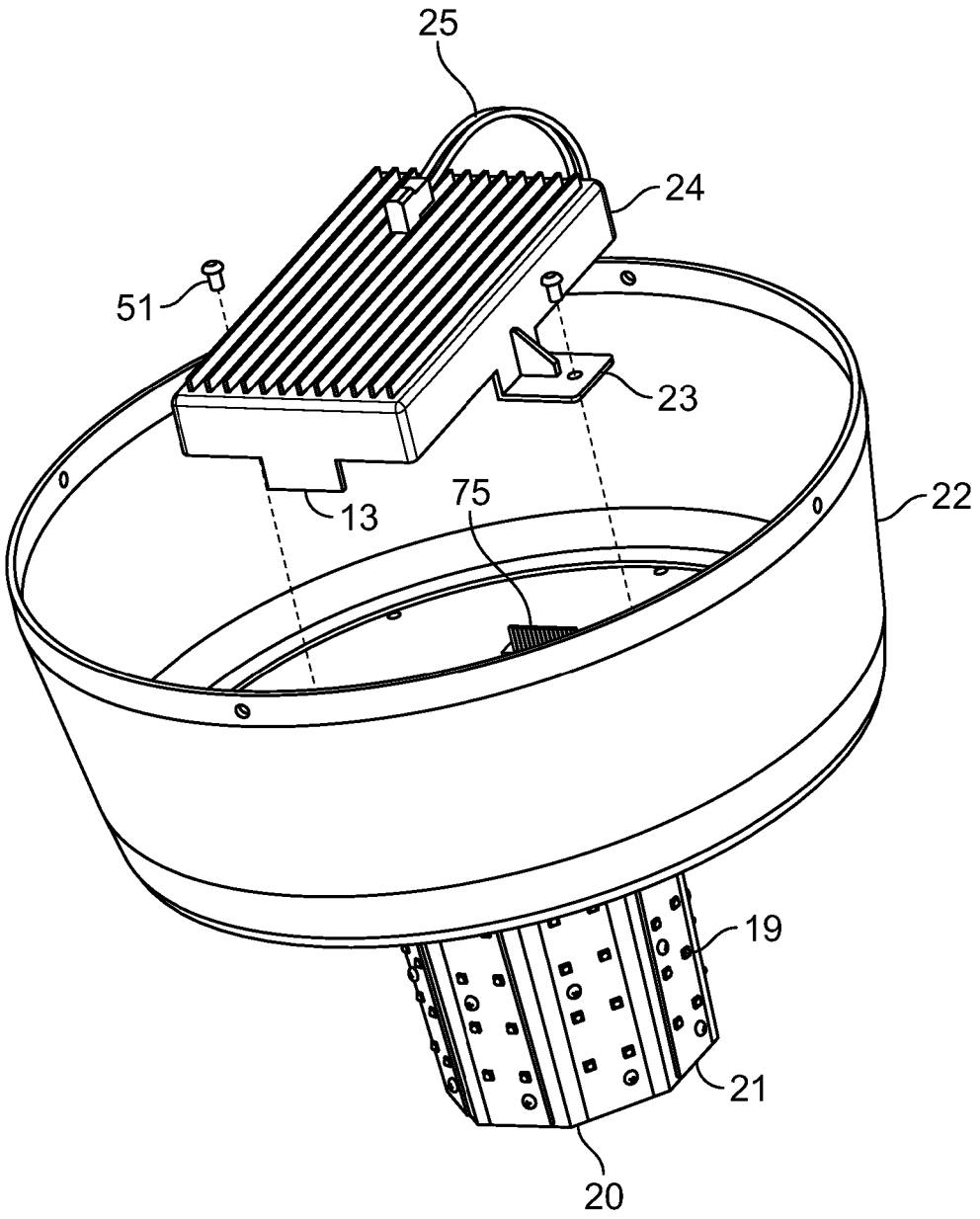
FIG. 11 is a schematic drawing showing the mounting of the LED driver to the internal cavity of the canister housing.

Now with reference to FIGS. 10 and 11, the LED driver (24) is mounted to the interior canister housing (22) using screws (51) through foot pads (23). The LED driver (24) is a self-contained power supply regulator that has outputs matched to the electrical characteristics of the LED (19) or array of LED printed circuit boards (21). There are many well known off the shelf drivers any number of them would work, but understanding the electrical characteristics of the LED or array is critical in selecting or designing a driver circuit. Drivers should be current-regulated (deliver a consistent current over a range of load voltages). Drivers may also offer dimming by means of pulse width modulation (PWM) circuits. Drivers may have more than one channel for separate control of different LEDs or arrays. The LED driver (24) includes a female connector (15) for connecting to the connector pins (75) that supply power to the LED printed circuit boards (21). The LED driver (24) receives power from the power supply through leads (25) with a connector that is connected to the power supply leads.

Figure 12:
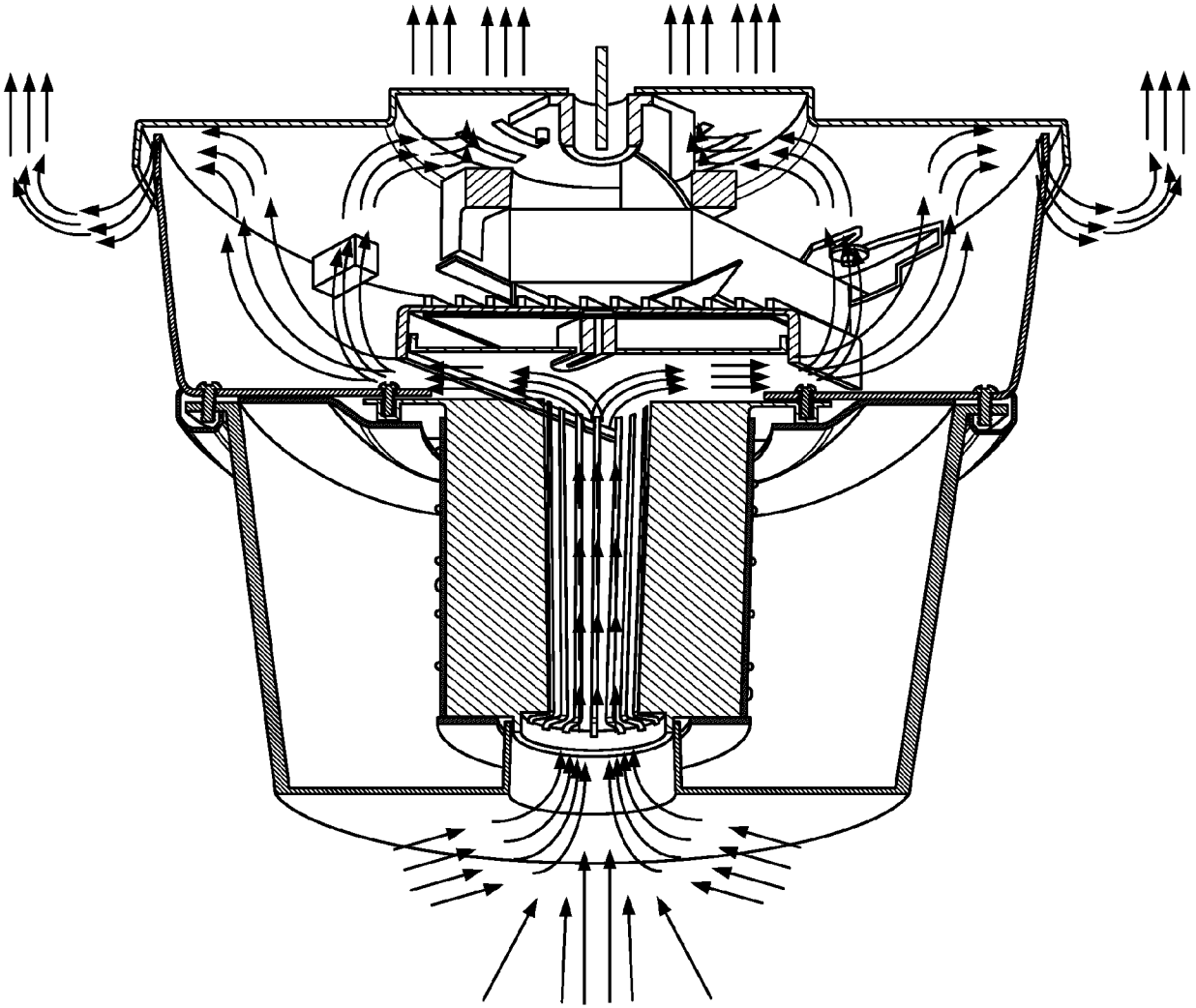
FIG. 12 is a front profile view of the lighting fixture of the present invention with vector lines representing the convective thermal air currents through the body of the lighting fixture.
Figure 13:
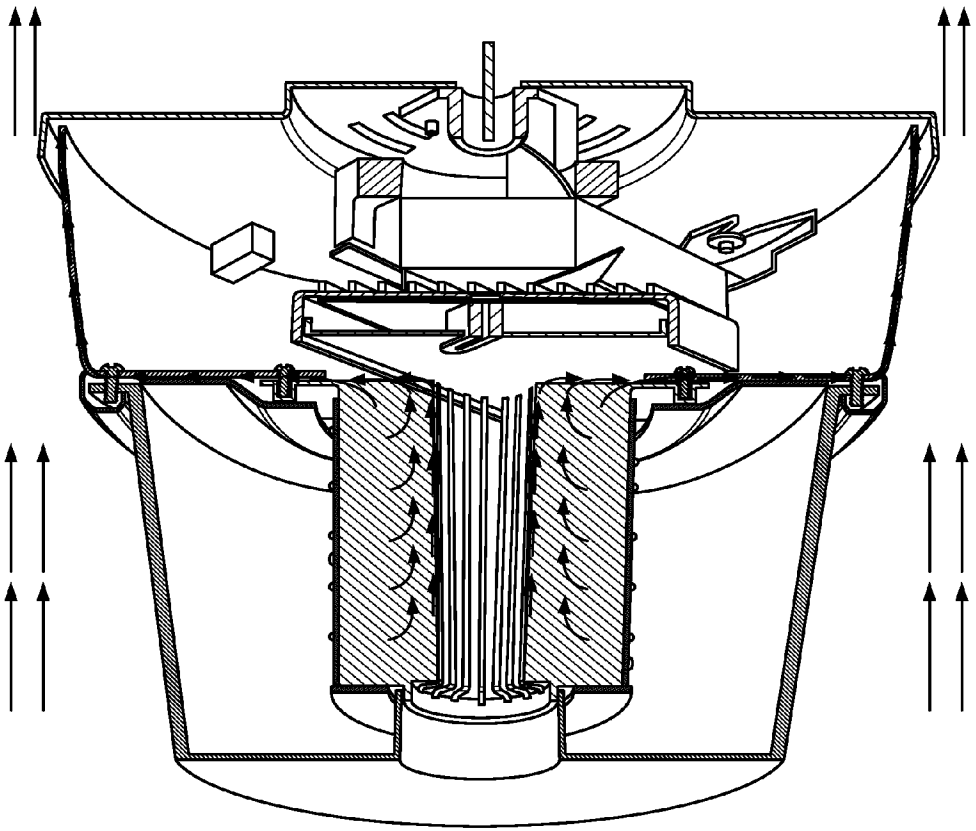
FIG. 13 is a front profile view of the lighting fixture of the present invention with vector lines representing the conductive thermal pathway through the body of the lighting fixture.
Figure 14:
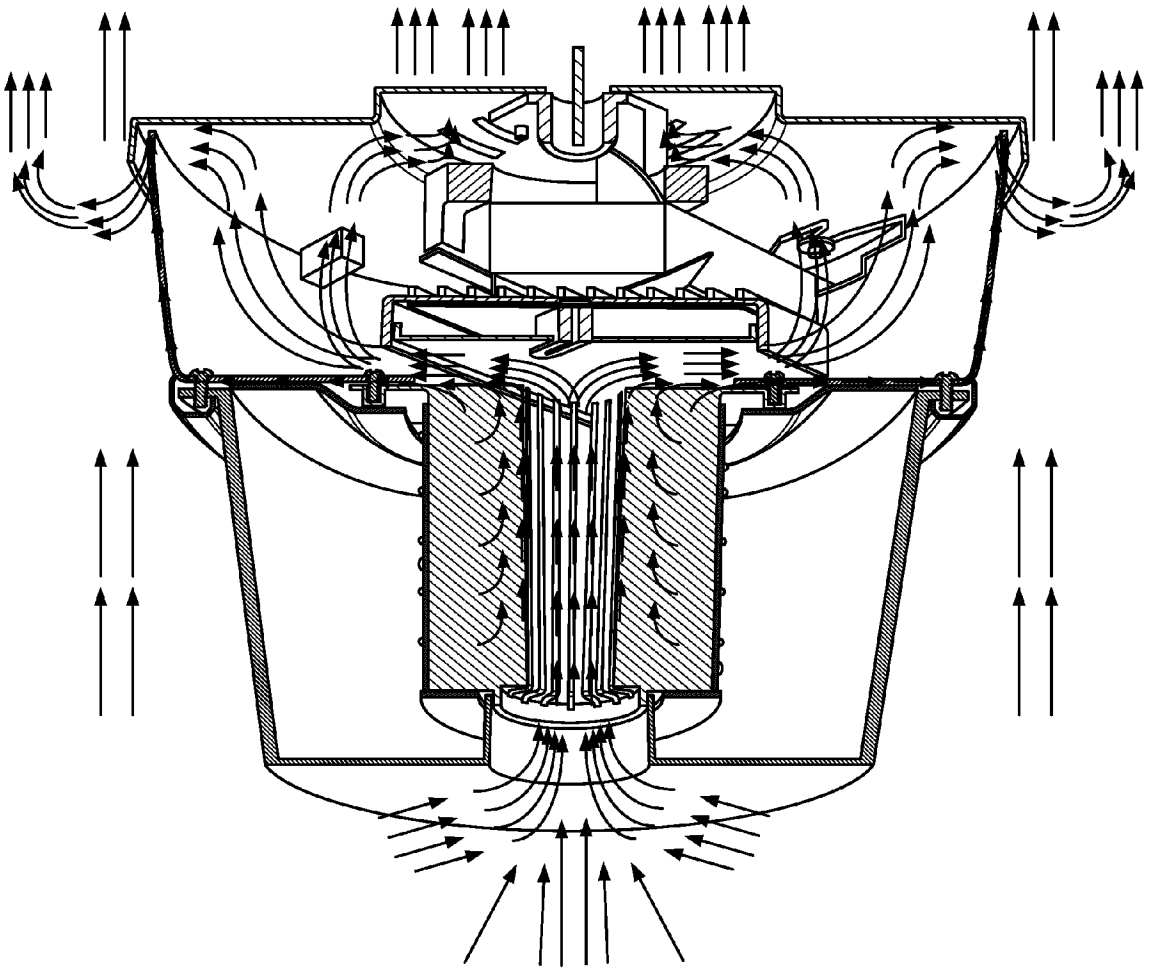
FIG. 14 is a front profile view of the lighting fixture of the present invention with vector lines representing the convective thermal air currents and the conductive thermal pathways through the body of the lighting fixture.

The thermal dissipation properties of the current invention represent a material improvement over previous designs. FIGS. 12, 13 and 14 represent the thermal currents and pathways of the inventive light fixture with enhanced thermal management.

Figure 15:
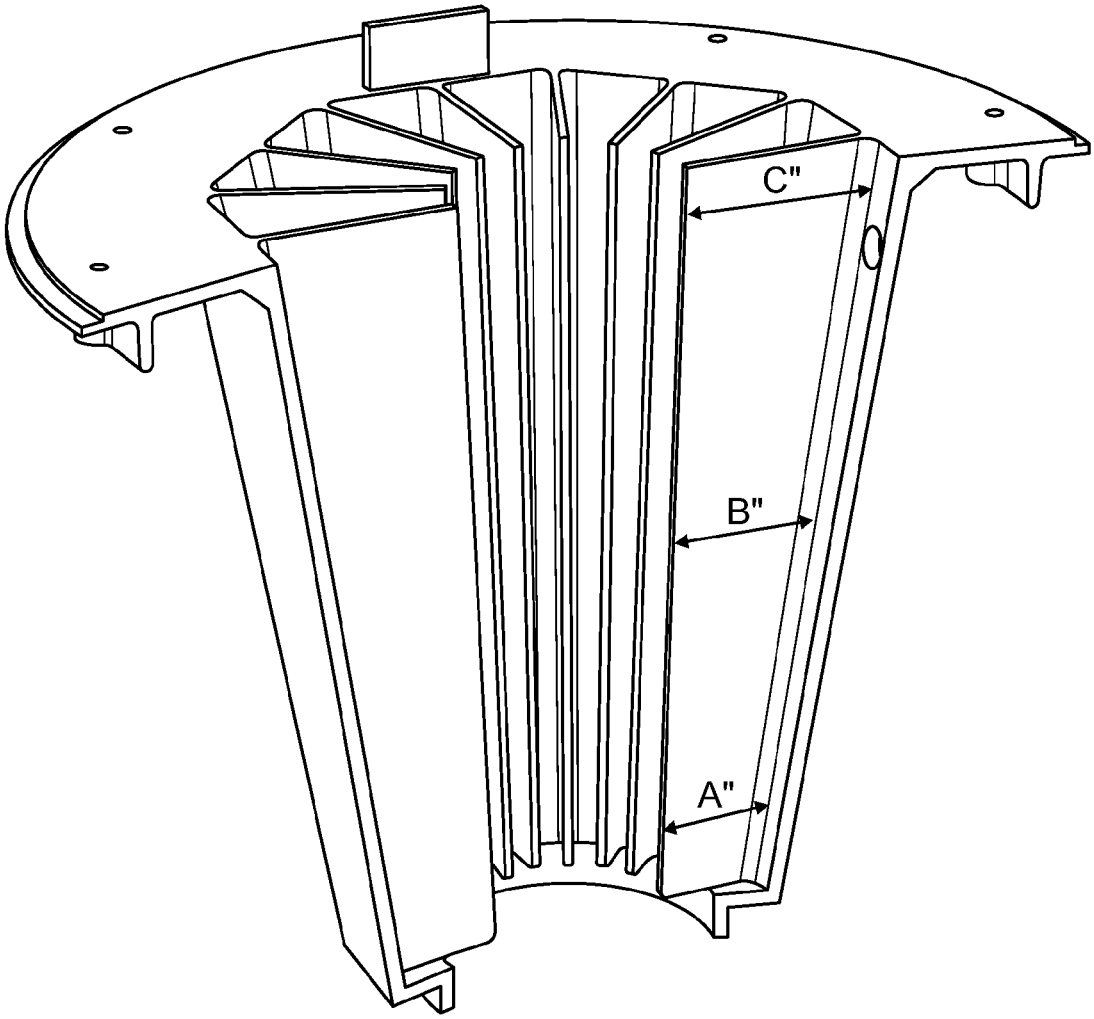
FIG. 15 is a schematic drawing of the heat sink showing the tapering of the fins.

FIG. 12 is a front sectional view of the preferred embodiment of the LED lighting fixture (10) and the convective air currents created by this design. As power is supplied to the LEDs (19), excess heat is generated and because of their close proximity, transferred conductively to the heat sink and heating the air between the fins and in the central tube. As the air in the central tube heats and expands it rises in the central tube and enters the chamber of the canister housing. As the air in the chamber of the canister housing expand, it exits the canister housing through the circulation vents in the top cover and the gap between the top cover and canister housing. Cooler denser air is drawn into and enters the light fixture through the lens opening, expanding and rising as it is heated, causing convective air currents to develop within the tube and housing chamber. Convective air currents are enhanced by the shaping and configuration of the fins within the central tube. The fins should be configured to be parallel with the tube and be placed sufficiently apart to allow the highest volume of air to flow through the heat sink assembly. In the preferred embodiment, the fins are tapered with broader surface area near the top of the heat sink and narrower surface area near the bottom of the heat sink. FIG. 15 shows this embodiment. The tapering of the fins allows for more total heat at the wider portion of the fin vs. the narrower portion, and thus causes hotter air near the top of the central tube vs. the bottom portion of the central tube. Such a configuration causes air to heat to expand more at the top of the central tube and draws denser cooler air in from the bottom of the central tube at the lens opening. These convective currents effectively remove heat from the fins of the heat sink reducing temperature of the entire heat sink assembly.

FIG. 13 shows the conductive heat currents of the inventive lighting fixture, with heat represented by vector lines and conductively moving from areas of high temperature to areas of low temperature. The efficiency of heat removal is determined by a number of well known variables described in the study of thermal dynamics, with temperature gradient and heat exchange area being most relevant. As indicated earlier, in the preferred embodiment, the heat sink, heat sink bezel and canister housing are all made from thermally conductive materials and are all in contact to form a thermal pathway. As power is supplied to the LEDs and heat is generated, the heat conductively moves to the heat sink from the LED printed circuit board heat sink interface. Heat is transferred to the outside environment through two pathways. In one pathway, heat moves from the LED printed circuit board to the heat sink, up the bottom pan of the canister housing to the outer canister housing. Heat is radiated from the canister housing to the environment. In the second pathway, heat moves from the LED printed circuit board to the heat sink to the heat sink bezel, up the bottom pan of the canister housing to the outer canister housing where it is radiated to the environment. Because the canister housing is exposed to the external environment of the lighting structure and made part of the thermal pathway, the temperature gradient in the pathway is greater and the amount of surface area of the overall efficiency of the conductive thermal dissipation system is significantly increased.

FIG. 14 demonstrates the cumulative thermal transfer effect of the combined conductive and convective thermal currents, which results in greater thermal dissipation over what could be expected from either method on a stand-alone basis. The convective current through the central tube and canister housing chamber is increased based on the configuration of the tapered heat sink fins and heat distribution patterns surface areas of the conductive thermal pathway. The enhanced convective current in turn results in a greater increase in thermal transfer at the surface area of the conductive thermal path. The combined effect resulting in enhanced heat removal While the above description has pointed out novel features of the present disclosure as applied to various embodiments, the skilled person will understand that various omissions, substitutions, permutations, and changes in the form and details of the present teachings illustrated may be made without departing from the scope of the present teachings.

Each practical and novel combination of the elements and alternatives described hereinabove, and each practical combination of equivalents to such elements, is contemplated as an embodiment of the present teachings. Because many more element combinations are contemplated as embodiments of the present teachings than can reasonably be explicitly enumerated herein, the scope of the present teachings is properly defined by the appended claims rather than by the foregoing description. All variations coming within the meaning and range of equivalency of the various claim elements are embraced within the scope of the corresponding claim. Each claim set forth below is intended to encompass any apparatus or method that differs only insubstantially from the literal language of such claim, as long as such apparatus or method is not, in fact, an embodiment of the prior art. To this end, each described element in each claim should be construed as broadly as possible, and moreover should be understood to encompass any equivalent to such element insofar as possible without also encompassing the prior art. Furthermore, to the extent that the term "includes" is used in either the detailed description or the claims, such term is intended to be inclusive in a manner similar to the term "comprises"

We claim:

1. A solid state lighting apparatus configured to provide for efficient dissipation of heat_comprising:

a) a thermally conductive housing canister having an interior cavity and incorporating within said cavity electrical power supply for providing electric power to the lighting apparatus;

b) a cover configured to prevent debris from entering the housing canister and further configured to provide a passage between the cover and the housing canister sufficient to allow air to flow from the interior cavity to the exterior environment;

c) a thermally conductive heat sink thermally associated with the housing canister and having_a central air channel extending the length of the heat sink to the housing canister and a plurality of cooling fins extending into the central air channel, wherein air flows from the air channel into the housing canister;

d) a plurality of solid state light sources powered by said electrical circuitry and thermally associated with the heat sink for conductively transferring heat from said plurality of solid state light sources to the heat sink;

e) a substantially transparent lens body enclosing said solid state light sources and heat sink, the lens body removably fixed to the housing and having an air gap and configured to be coupled to the central air gap of the heat sink, whereby debris is prevented from entering the lens body.

2. The solid state lighting apparatus of claim 1, wherein the solid state light source comprises a light emitting diode.

3. The solid state lighting apparatus of claim 2, wherein the light emitting diode comprises a plurality of light emitting diodes disposed on a printed circuit board.

4. The solid state lighting apparatus of claim 1, wherein the interior surface of the lens body further comprises a plurality of facets for reflecting light.

5. The solid state lighting apparatus of claim 1, wherein the cooling fins are tapered, whereby convective thermal air flows into the central air channel and exists the housing canister.

6. The solid state lighting apparatus of claim 1, further comprising a thermally conductive heat sink bezel fixed to the heat sink and the housing and providing a conductive thermal path to radiate heat to the exterior environment.

7. A solid state lighting apparatus comprising:

a) a thermally conductive housing canister having a cover with vents, the housing canister having a first air gap, an interior cavity, and a second air gap between the cover and housing canister;

b) a thermally conductive heat sink with an air entry side and an air exit side and having an open interior area extending from the air entry side to the air exit side and further having a plurality of tapered cooling fins extending into the interior area such that the cooling fins are narrower at the air entry side providing for a lower temperature at the entry side during operation and wider at the air exit side providing for a higher temperature at the exit side during operation such that convective air current is generated, the heat sink coupled with the conductive housing to provide a thermally conductive pathway and whereby the air entry side and the air exit side of the interior area are engaged to provide an air current pathway;

c) a plurality of solid state light sources thermally associated with the heat sink for conductively transferring heat from said plurality of solid state light sources to the heat sink;

d) a lens body enclosing said solid state light sources and heat sink, the lens body having an opening coupled to the entry side of the interior area for allowing convective air flow through the lighting apparatus.

8. The solid state lighting apparatus of claim 7, wherein the solid state light source comprises a light emitting diode.

9. The solid state lighting apparatus of claim 8, wherein the light emitting diode is coupled to a printed circuit board.

10. The solid state lighting apparatus of claim 9, wherein the printed circuit board is powered by an electric power supply.

11. The solid state lighting apparatus of claim 7, wherein the interior surface of the lens body further comprises a plurality of facets for reflecting light.

* * * * *